US006851144B2

(12) United States Patent
Wang

(10) Patent No.: US 6,851,144 B2
(45) Date of Patent: Feb. 8, 2005

(54) POWER-CONTROLLED BED AND METHOD FOR CONTROLLING OPERATIONS THEREOF

(76) Inventor: Yi-Lung Wang, 6th-Floor, No. 162, May Jin Road, Keelung City (TW)

( * ) Notice: Subject to any disclaimer, the term of this patent is extended or adjusted under 35 U.S.C. 154(b) by 0 days.

(21) Appl. No.: 10/394,044

(22) Filed: Mar. 24, 2003

(65) Prior Publication Data

US 2004/0187213 A1 Sep. 30, 2004

(51) Int. Cl.[7] ..... A61G 7/008
(52) U.S. Cl. ..... 5/610; 5/611; 5/616; 5/109
(58) Field of Search ..... 5/610, 611, 616, 5/108, 109; 108/145, 147

(56) References Cited

U.S. PATENT DOCUMENTS 1,037,419 A * 9/1912 Bosanko ..... 5/610
4,435,862 A * 3/1984 King et al. ..... 5/611
4,769,584 A * 9/1988 Irigoyen et al. ..... 318/648
4,856,129 A * 8/1989 Butler ..... 5/610
5,615,255 A * 3/1997 Lemieux ..... 379/230
5,940,911 A * 8/1999 Wang ..... 5/610
6,353,949 B1 * 3/2002 Falbo ..... 5/610

* cited by examiner

*Primary Examiner*—Michael F. Trettel
(74) *Attorney, Agent, or Firm*—Troxell Law Office PLLC

(57) ABSTRACT

A power-controlled bed mainly includes an upper bed frame on which a mattress divided into movable back, thigh, and leg rest parts and a fixed hip rest part is supported; a lower bed frame; at least one lifting mechanism pivotally connected at upper and lower ends to the upper and the lower bed frames, respectively; and a microcomputer controller for controlling operation of the lifting mechanism. The lifting mechanism may be manually controlled for the upper bed frame to statically stay at different positions, or be automatically controlled via the controller to dynamically shift the upper bed frame between two or more selected position combinations, so that the force of gravity is well utilized in the movements of the bed to promote a user's blood circulation, help clearing of sputum, enable sufficient supply of oxygen to the brain, do rehabilitation exercises, etc.

5 Claims, 11 Drawing Sheets

POWER-CONTROLLED BED AND METHOD FOR CONTROLLING OPERATIONS THEREOF

BACKGROUND OF THE INVENTION

1. Field of the Invention

The present invention relates to a power-controlled bed, and more particularly to a power-controlled bed having an upper bed frame adapted to statically stay at a selected position or dynamically shift between two or more selected position combinations through manual or automatic control, so that the bed could be used in homes, hotels, recreation centers, hospitals and other health-care centers in the form of furniture or medical instrument. The present invention also relates to a method for controlling operations of the power-controlled bed.

2. Description of the Prior Art

There are many types of power-controlled beds known in the prior art. The following are some examples of these conventional power-controlled beds:

a. Taiwan New Utility Model Patent Application No. 87218307 laid open under Patent Publication No. 370869 entitled "A Power-controlled Bed" discloses a power-controlled bed for leisure purpose, a back-resting portion and a leg-resting portion of a mattress of the bed may be adjusted to different angles of elevation.
b. Taiwan New Utility Model Patent Application No. 86200788 laid open under Patent Publication No. 325689 entitled "An Automatic Sickbed" discloses a general sickbed including a mattress that has angle and height adjustable back-resting and leg-resting portions.
c. Taiwan New Utility Model Patent Application No. 82210483 laid open under Patent Publication No. 268281 entitled "A Bed for Rehabilitation" discloses a bed as an aid to rehabilitation. The bed is particularly designed for medical and rehabilitating purposes and could be adjusted to different angles of inclination.
d. Taiwan Invention Patent Application No. 87114125 laid open under Patent publication No. 372863 entitled "A Multi-functional Bed Structure and Method for Controlling Operations Thereof", and a corresponding Chinese Invention Patent Invention Application No. 01131350.1 entitled "A Power-controlled Bed and Method for Controlling Operations Thereof", both invented by the same inventor of the present invention.

All the above-mentioned leisure beds and sickbeds, which are either prior art or laid open, could not be adjusted to a considerably large angle of elevation, and could not be dynamically shifted between two or more position combinations. Furthermore, the conventional power-controlled beds for medical treatment and rehabilitation purposes, including those of the prior art and that disclosed in the inventor's Taiwan Patent Publication No. 372863, include complicate structures and are therefore too expensive to be widely accepted by most consumers.

SUMMARY OF THE INVENTION

It is therefore tried by the inventor to improve and simplify the multi-functional bed structure invented by the same inventor, so that a simplified, improved, and economical power-controlled bed is developed to provide not only the general functions of adjusting the back-resting portion and the leg-resting portion of the mattress to different angles of inclination, but also a plurality of bed position combinations for an upper bed frame thereof to shift continuously and automatically in different manners that are not found in the conventional multi-functional bed structures, including inclining at a large angle, automatically and continuously shifting two ends between two or more inclinations and/or lifting and lowering the two ends between two or more different heights. With the changeful bed position combinations, the force of gravity is well utilized to promote the blood circulation in human body, to help a patient suffering from a lung-related disease to lie on the bed with downward inclined head to clear sputum more easily, to obtain sufficient supply of oxygen to the brain, etc.

To achieve the above and other objects, the power-controlled bed of the present invention mainly includes a mattress divided into a movable back rest part, a fixed hip rest part, a movable thigh rest part, and a movable leg rest part; a movable upper bed frame; a fixed lower bed frame; at least one lifting mechanism mounted on the lower bed frame to ascend, descend, or incline the upper bed frame; and at least one raising mechanism mounted below the fixed hip rest part for adjusting the movable back rest part and the movable leg rest part to different angles of elevation.

The lifting mechanism includes two pairs of upper and lower cranks, inner ends of which are connected to each other via a pivot joint, and outer ends of which are connected to corresponding points on the upper and the lower bed frames, respectively, via pivot joints, too. The pivot joint includes a pin shaft extended through two cranks for the latter to rotate via bearings. An upper and a lower crossbar are extended between the two upper and the two lower cranks, respectively, to connect them together. Either a vertical or a horizontal threaded-rod elevator is connected to and between the upper and the lower crossbars to move the two crossbars and thereby pushes or pulls the upper cranks away from or close to the lower cranks to lift or lower the upper bed frame, respectively. Lifting mechanisms separately provided below front and rear ends of the bed could be synchronously or separately operated via a microcomputer controller. A user may use the controller to enter instructions to independently adjust the bed to statically stay at different heights and inclinations or to set the bed to automatically and dynamically shift between two or more position combinations.

Spring-loaded locators are provided at predetermined positions near joints of the upper cranks and the upper bed frame and joints of the lower cranks and the lower bed frame to serve as buffers when the cranks are caused to move about the pivot joints, and to limit the cranks to an acceptable range of movement.

A bottom crossbar is provided below each lower crossbar to extend between a pair of the lower cranks located at each end below the upper bed frame. The bottom crossbar is provided at a middle point with crank pivoting means. When the upper bed frame is located at a medium height and the lifting mechanisms are held in a stopped state (that is, the lifting mechanisms and the crank pivoting means are not allowed to operate at the same time), the crank pivoting means may be actuated for the upper bed frame to reciprocatingly translate and thereby swing forward and backward within a range of axial movement of the lower cranks.

The following are some of the functions that could be achieved through the raising and the lifting mechanisms of the power-controlled bed of the present invention:

a. The movable back rest part, the thigh rest part, and the leg rest part of the mattress of the bed could be flattened at the same time to a horizontal position by manually controlling the raising mechanism, so that the bed could be used as a general horizontal bed.

b. The movable back rest part, the thigh rest part, and the leg rest part of the mattress of the bed could be adjusted to different angles of elevation by manually controlling the raising mechanism, so that a user could lie on the bed in the most comfortable position.

c. The upper bed frame could be adjusted to different heights and inclinations within a large range by manually controlling the lifting mechanism.

d. The upper bed frame could be statically or dynamically shifted between two or more heights and inclinations through automatic operation of the lifting mechanism set by pushing keys on the controller, so that a user may have multiple choices in operating the bed;

e. The lifting mechanism could be manually operated to adjust the upper bed frame to a large angle of elevation suitable for a patient suffering from a lung-related disease to clear sputum from the chest easily. Means may be provided to work with the lifting mechanism to prevent the patient from slipping downward on the inclined bed.

f. The lifting mechanism could be manually operated to adjust the upper bed frame to a large angle of elevation suitable for supplying sufficient oxygen to the user's brain and relieving symptoms of varicose veins, hemorrhoids, gastroptosis, and compressed spine that are in connection with the force of gravity when the user is lying on the bed with the head pointed downward.

g. When the bed is set to automatically shift between two or more selected position combinations within a set operating time, the upper bed frame is dynamically, repeatedly, and alternately shifted between the selected modes to well utilize the force of gravity to alternately change positions of the user's head and feet, in order to promote the user's blood circulation and protect the user from a stroke.

h. When the bed is set to a dynamic state being automatically operated in a continuous manner, it functions like a cradle to help the user to get to sleep.

i. When the bed is set to a random state being automatically operated in a continuous manner, it helps to distract the user's attention due to the unpredictable movements of the bed and thereby temporarily relieves the user from constant pressure.

j. When the bed is in a medium height and the lifting mechanisms are held in a stopped state, the crank pivoting means may be actuated for the bed to reciprocatingly translate and thereby swing forward and backward within the range of movement of the bed in a horizontal position.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
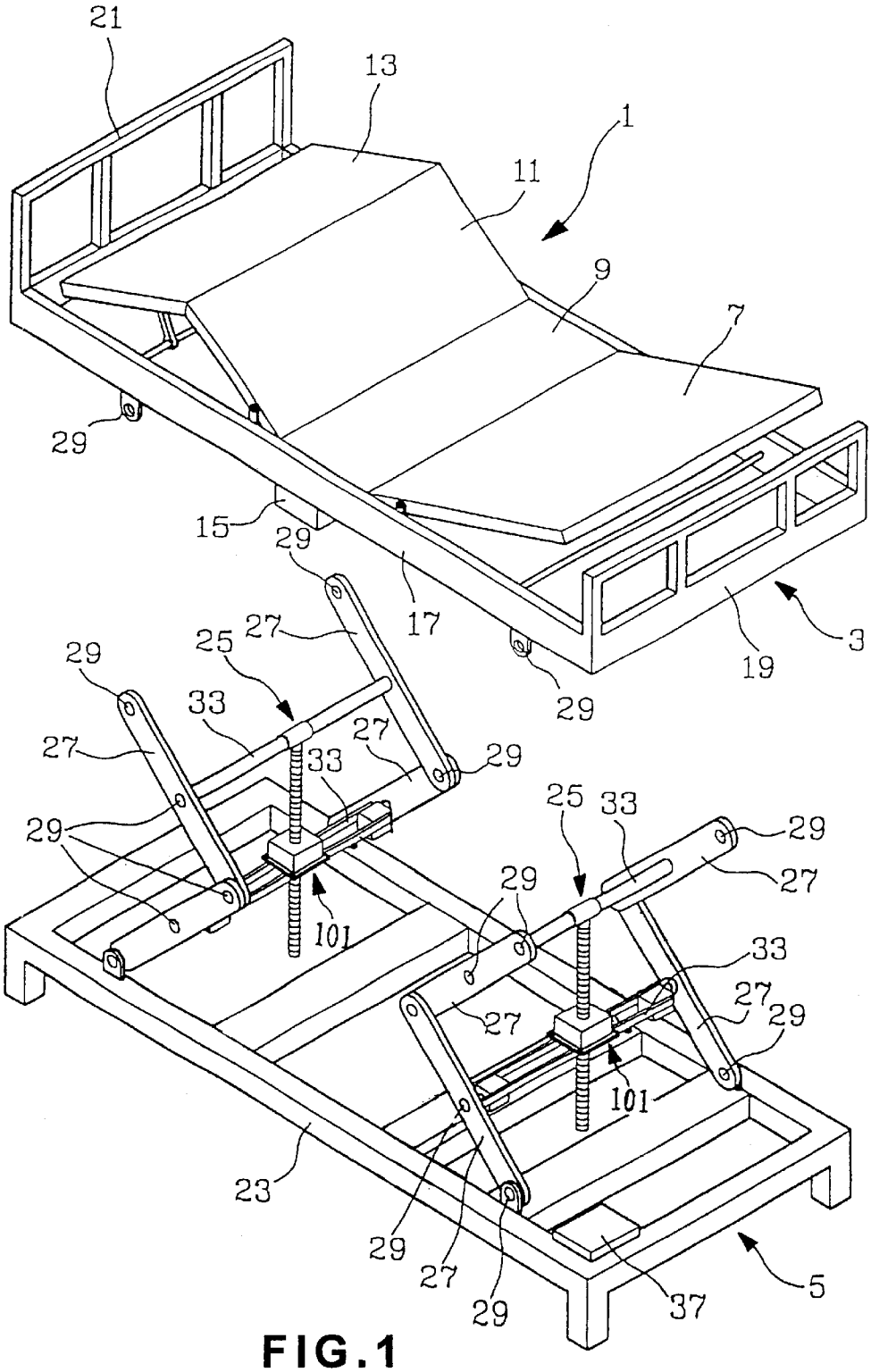
FIG. 1 is an exploded perspective view of a power-controlled bed according to a first embodiment of the present invention, wherein two ends of a mattress of the bed could be separately adjusted with raising mechanisms to different angles of inclination.
Figure 2A:
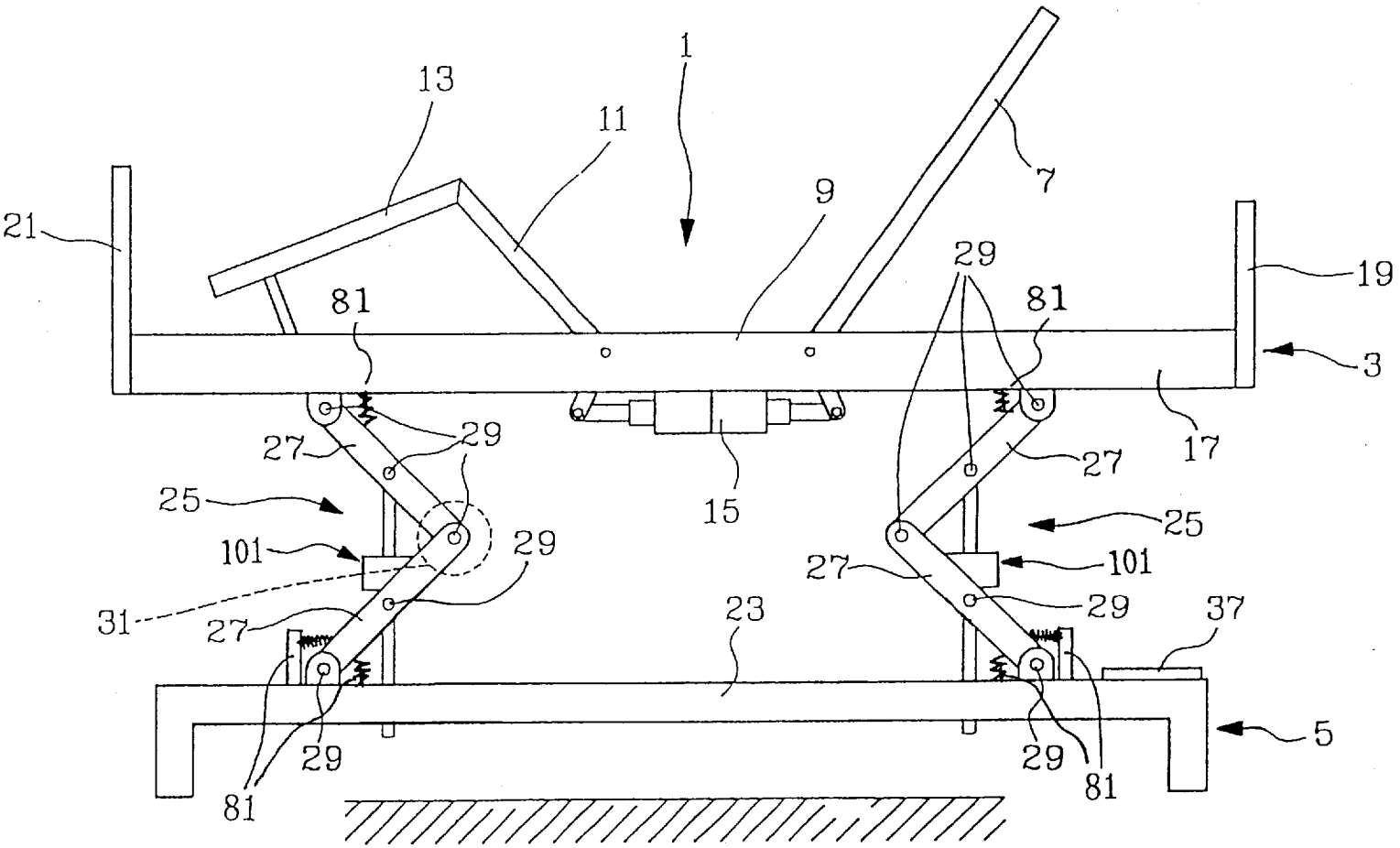
FIG. 2A is an assembled side view of FIG. 1, wherein an upper bed frame of the bed is lifted from a lower bed frame thereof with two lifting mechanisms.
Figure 2B:
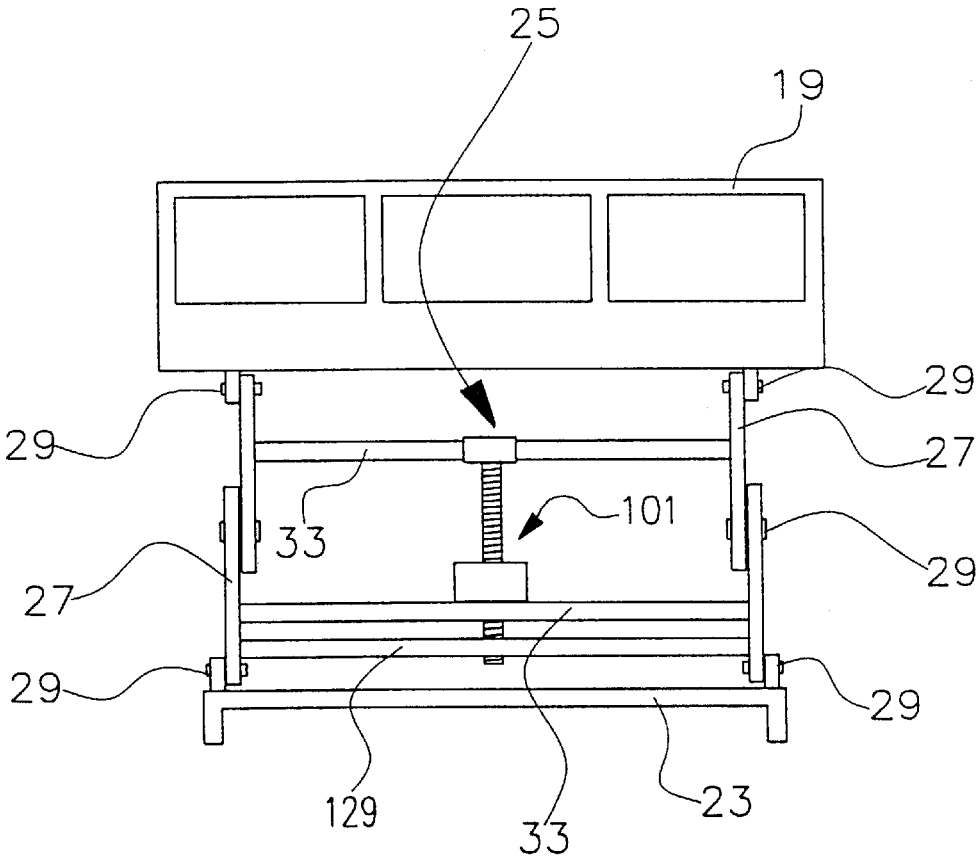
FIG. 2B is a front elevational view of FIG. 2A.

The present invention relates to power-controlled beds. In consideration of manufacturing cost and selling price, two embodiments of the present invention are available for consumers. FIGS. 1, 2A, and 2B are sequentially exploded perspective view, assembled side view, and front elevational view of a power-controlled bed 1 according to the first embodiment of the present invention, wherein two ends of an upper bed frame 17 of the bed 1 could be separately lifted by two lifting mechanisms 25 to different heights relative to a lower bed frame 23, and two ends of a mattress of the bed 1 could be raised by two raising mechanisms 15 to different angles of inclination; and FIGS. 3, 4A, and 4B are sequentially exploded perspective view, assembled side views, and front elevational view of a power-controlled bed 1 according to the second embodiment of the present invention, wherein only a rear end of an upper bed frame 17 of the bed 1 could be raised by a lifting mechanism 25 to different angles of inclination relative to a lower bed frame 23.

Please refer to FIGS. 1, 2A, and 2B. The power-controlled bed 1 according to the first embodiment of the present invention includes a top structure 3 and a chassis structure 5. The top structure 3 includes a mattress divided into four parts, namely, a movable back rest part 7, a fixed hip rest part 9, a movable thigh rest part 11, and a movable leg rest part 13; and an upper bed frame 17 for supporting the mattress thereon. Two conventional mattress raising mechanisms 15 are mounted below the fixed hip rest part 9 to separately adjust an angle of elevation of the back rest part 7 relative to the upper bed frame 17 and arch or flatten the thigh rest part 11 and the leg rest part 13 that are pivotally connected to each other. The top structure 3 also includes a protective headboard 19 and a protective footboard 21.

The chassis structure 5 includes a lower bed frame 23, on which a front and a rear lifting mechanism 25 are mounted. Each of the two lifting mechanisms 25 includes two pairs of upper and lower cranks 27. The upper and the lower cranks 27 in each pair are connected at inner ends to each other by a first pivot joint 29, and at outer ends to corresponding points on the upper bed frame 17 and the lower bed frame 23, respectively, by second pivot joints 29. An upper and a lower crossbar 33 are extended between and connected to two upper and two lower cranks 27, respectively, in each lifting mechanism 25. In a first embodiment of the lifting mechanism 25, a vertical threaded-rod elevator 101 is connected to and between the upper and the lower crossbar 33. And, in a second embodiment of the lifting mechanism 25, a horizontal threaded-rod elevator 103 is connected to and between the upper and the lower crossbar 33. Both the vertical and the horizontal threaded-rod elevator 101, 103 are capable of pushing or pulling the upper and the lower crossbars 33 and thereby respectively moving the upper cranks 27 away from or close to the lower cranks 27, bringing the upper bed frame 17 to ascend or descend, respectively. Since the threaded-rod elevators 101 or 103 of the two lifting mechanisms 25 could be synchronously or independently controlled via a microcomputer controller 37 mounted on the chassis structure 5, the height of the upper bed frame 17 and the angles of inclination of the movable parts 7, 11, and 13 of the mattress may be manually adjusted depending on a user's actual need, or be automatically controlled to change between dynamic and static operating modes. Spring-loaded locators 81 are provided at predetermined positions near joints 29 of the upper cranks 27 and the upper bed frame 17 and joints of the lower cranks 27 and the lower bed frame 23 to serve as buffers when the cranks 27 are caused to move about the pivot joints 29, and to prevent the upper bed frame 17 from moving out of a range of movement set for it.

Figure 3:
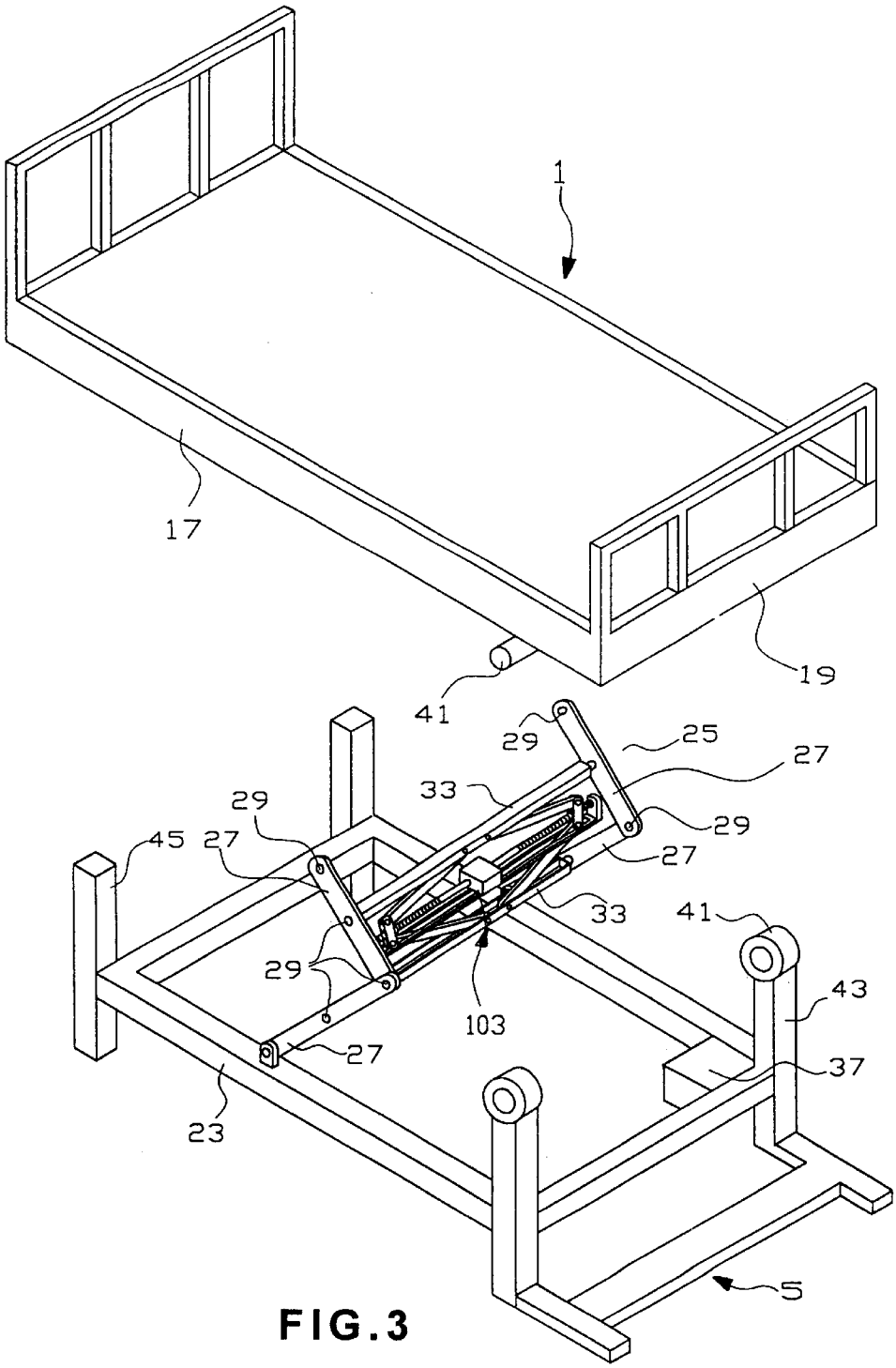
FIG. 3 is an exploded perspective view of a power-controlled bed according to a second embodiment of the present invention, wherein only a rear end of an upper bed frame of the bed could be adjusted to different angles of inclination.
Figure 4A:
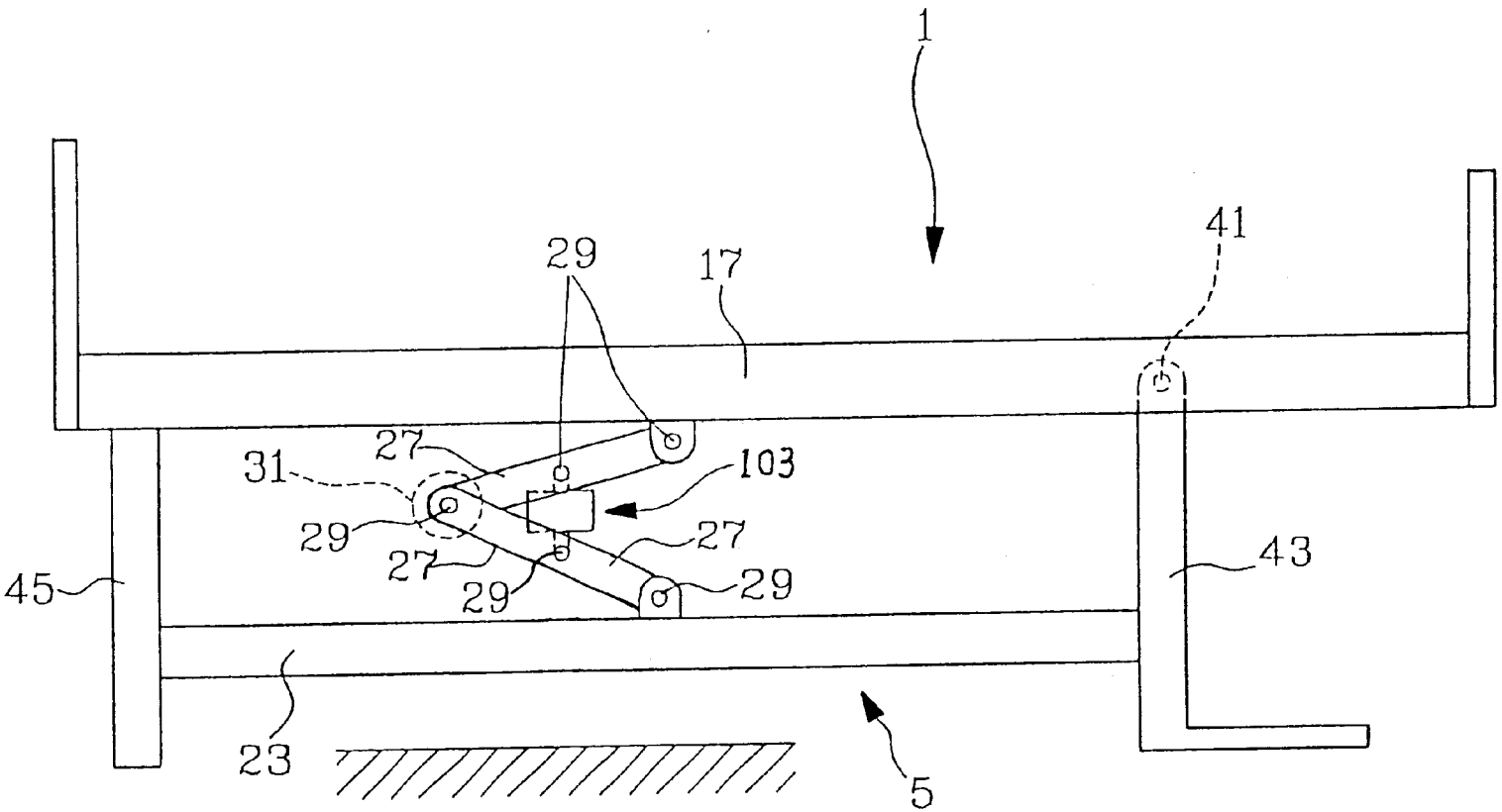
FIG. 4A is an assembled side view of FIG. 3, wherein the upper bed frame of the bed is horizontally located on a lower bed frame thereof.
Figure 4B:
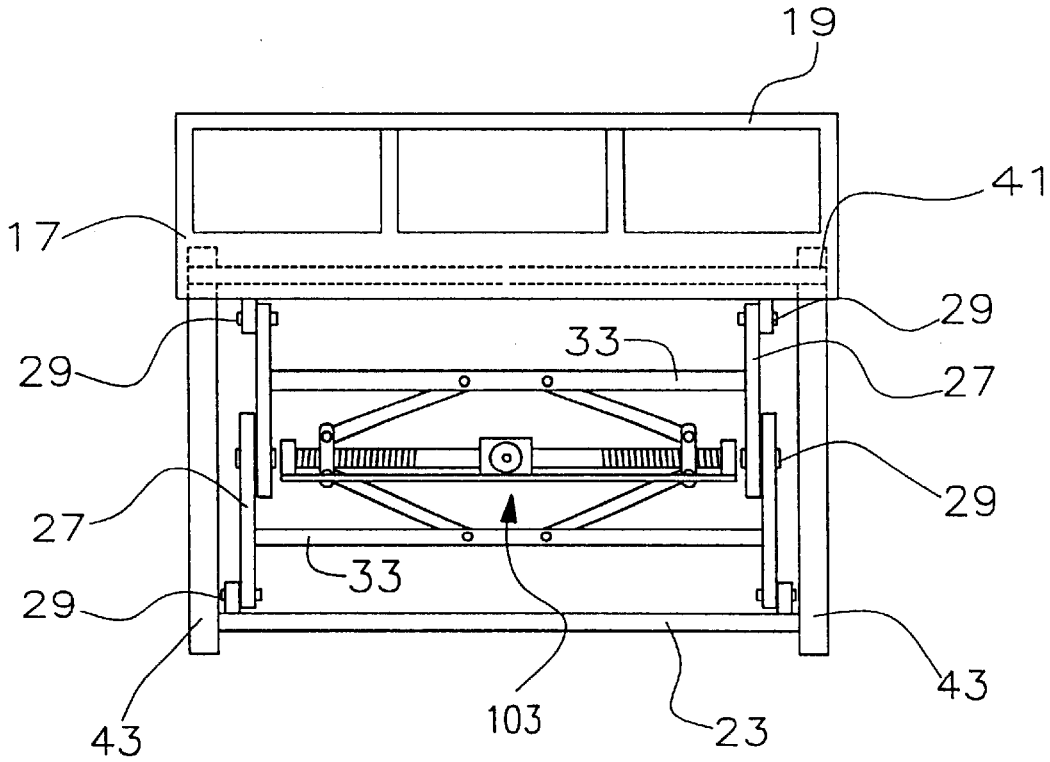
FIG. 4B is a front elevational view of FIG. 4A.

Please refer to FIGS. 3, 4A, and 4B. The power-controlled bed 1 according to the second embodiment of the present invention includes an upper bed frame 17 and a chassis structure 5 consisting of a front leg support 43, a lower bed frame 23, and a rear leg support 45. The upper bed frame 17 is pivotally connected near a lower front end to upper ends of the front leg support 43 of the chassis structure 5 via fixed pivot joints 41, and near a lower rear end to a lifting mechanism 25 mounted near a middle portion of the lower bed frame 23. The lifting mechanism 25 includes a pair of upper and lower cranks 27. The upper and the lower cranks 27 are connected at inner ends to each other by first pivot joints 29 and at outer ends to corresponding positions on rear portions of the upper and the lower bed frames 17 and 23, respectively, via second pivot joints 29. An upper and a lower crossbar 33 are extended between and connected to the upper and the lower cranks 27, respectively. A vertical or a horizontal threaded-rod elevator 101, 103 is connected to and between the upper and the lower crossbars 33 to move the upper crossbar 33 away from or close to the lower crossbar 33 and thereby push or pull the upper and the lower cranks 27 away from or close to each other, so that the rear end of the upper bed frame 17 is lifted from the rear leg support 45 to incline the whole upper bed frame 17. Since the threaded-rod elevator 101 or 103 could be controlled via a microcomputer controller 37 mounted on the chassis structure 5, a considerably large angle of inclination of the upper bed frame 17 may be manually adjusted depending on a user's actual need, or be automatically controlled to dynamically operate among one or more selected operating modes.

Figure 5A:
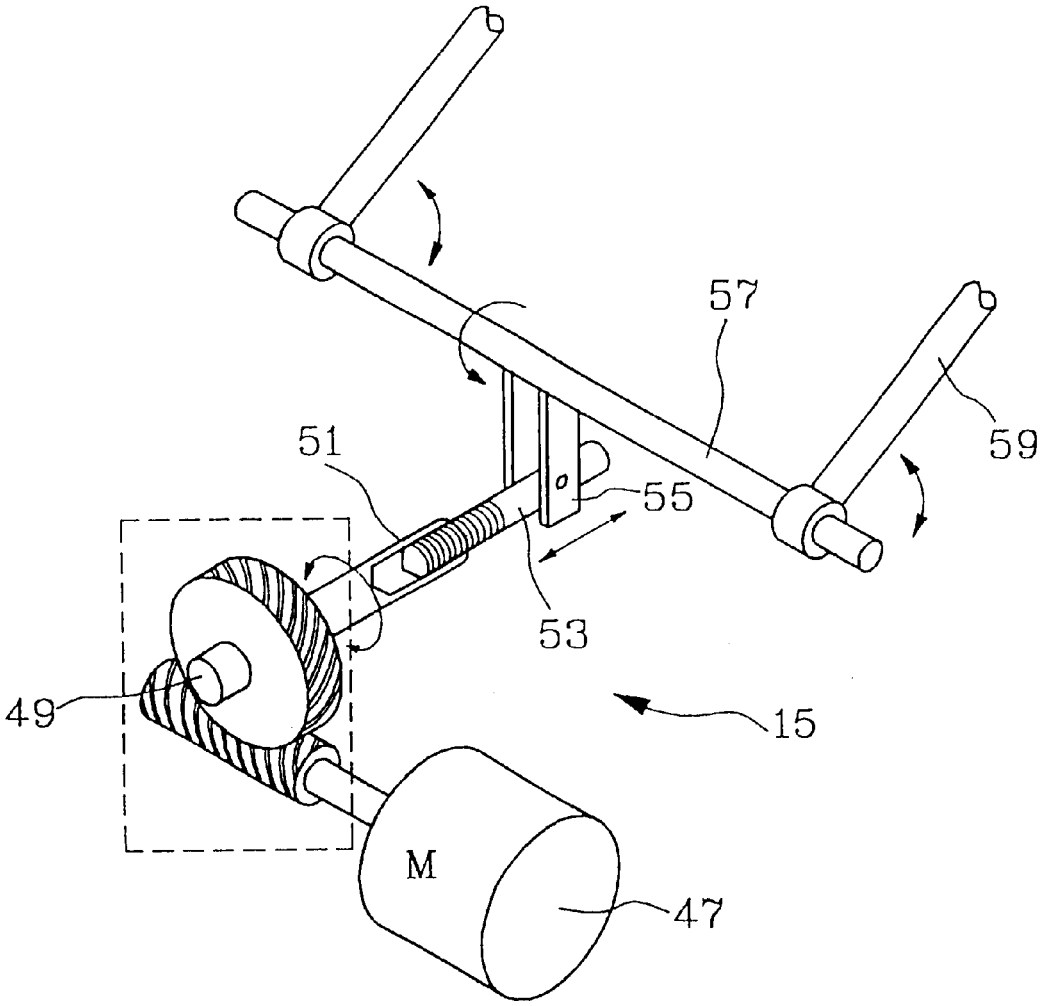
FIG. 5A is a fragmentary, enlarged perspective view of the raising mechanism for the power-controlled bed of the present invention.

FIG. 5A is a fragmentary, enlarged perspective view of one of the two conventional mattress raising mechanisms 15 mounted below the fixed hip rest part 9 of the power-controlled bed 1 of the present invention. Each of the raising mechanism 15 includes a motor 47 that drives a reduction gearbox 49 to rotate an internally threaded sleeve 51 formed in front of the gearbox 49, so that an externally threaded shifting rod 53 engaged with the threaded sleeve 51 is extended or retracted to push or pull links 55 extended between a front end of the shifting rod 53 and a transverse shaft 57. In this manner, the links 55 rotate the transverse shaft 57 for the same to raise or lower two raising arms 59 fixedly connected at lower ends to two ends of the transverse shaft 57 and at upper ends to the back rest part 7 or the connected thigh rest part 11 and leg rest part 13, so that the parts are adjusted to different angles of inclination relative to the lower bed frame 23.

Figure 5C:
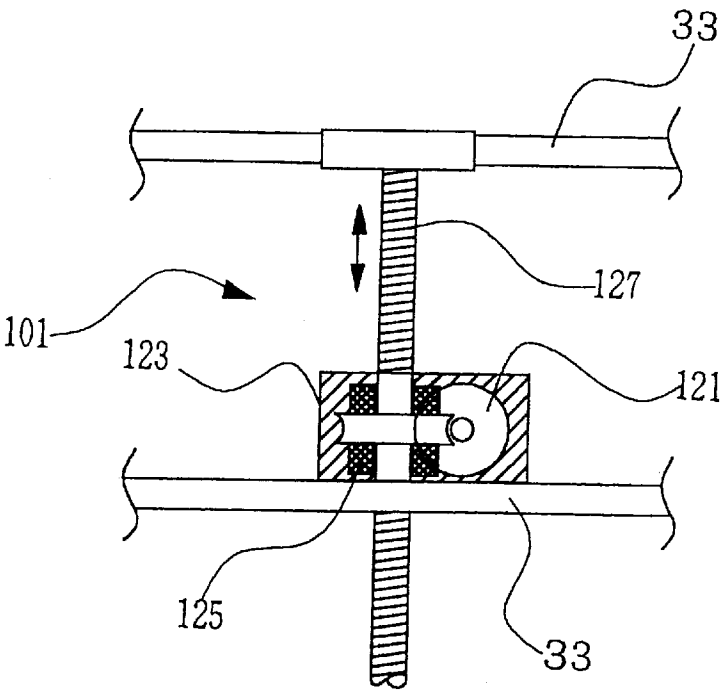
FIG. 5C is a partially sectioned side view of another embodiment of the lifting mechanism for the power-controlled bed of the present invention.
Figure 5B:
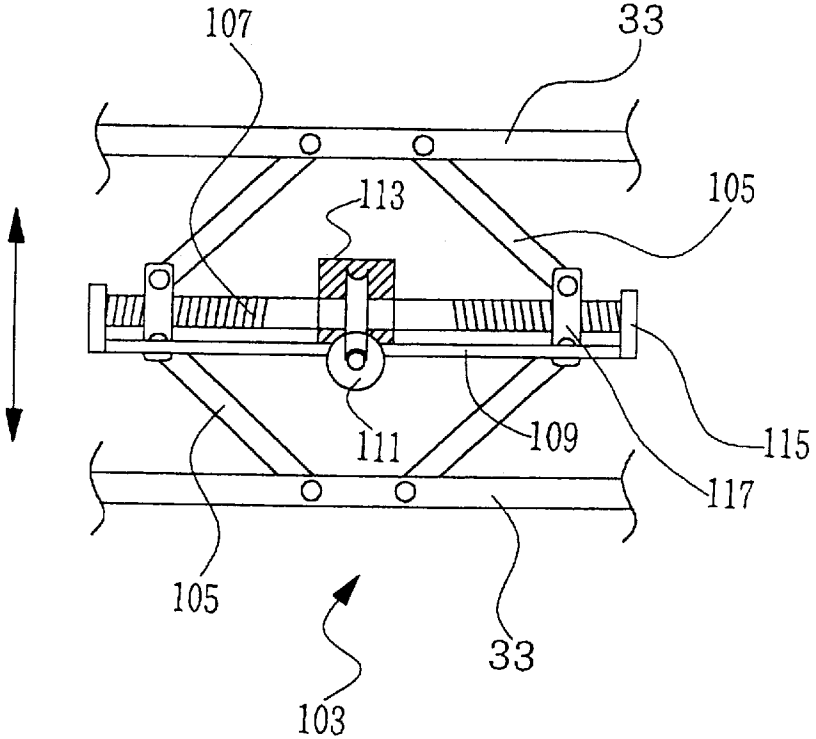
FIG. 5B is a partially sectioned side view of an embodiment of the lifting mechanism for the power-controlled bed of the present invention.

FIG. 5B is a partially sectioned side view of the horizontal threaded-rod elevator 103 connected to and between the upper and the lower crossbar 33. The horizontal threaded-rod elevator 103 includes a rhombic linkage having four movable links 105, outer ends of which being separately connected to the upper and the lower crossbar 33, and inner ends of which being connected to two horizontally spaced and internally threaded rings 117, and a motor 111 connected to a suspension bottom plate 109 for driving a speed change gearbox 113 to rotate a threaded rod 107, which is rotatably mounted between two bearings 115 located at two outer ends of the suspension bottom plate 109 to extend through the two internally threaded rings 117 and is provided on two opposite sections at two sides of the gearbox 113 with reverse threads. Whereby when the motor 111 is actuated, the internally threaded rings 117 spaced on the two opposite sections of the threaded rod 107 are brought to displace relative to each other and thereby force the four links 105 of the rhombic linkage to different angular positions relative to the upper and the lower crossbar 33 to thereby push or pull the upper and the lower crossbar 33 and accordingly adjust an openness between the upper and the lower cranks 27.

FIG. 5C is a partially sectioned side view of the vertical threaded-rod elevator 101 connected to and between the upper and the lower crossbar 33. The vertical threaded-rod elevator 101 includes a motor 121 that drives a speed change gearbox 123 to rotate an internally threaded ring 125, so that a threaded rod 127 meshed with the threaded ring 125 is caused to move up and down and thereby pushes or pulls the crossbars 33 to adjust an openness between the upper and the lower cranks 27.

Figure 6A:
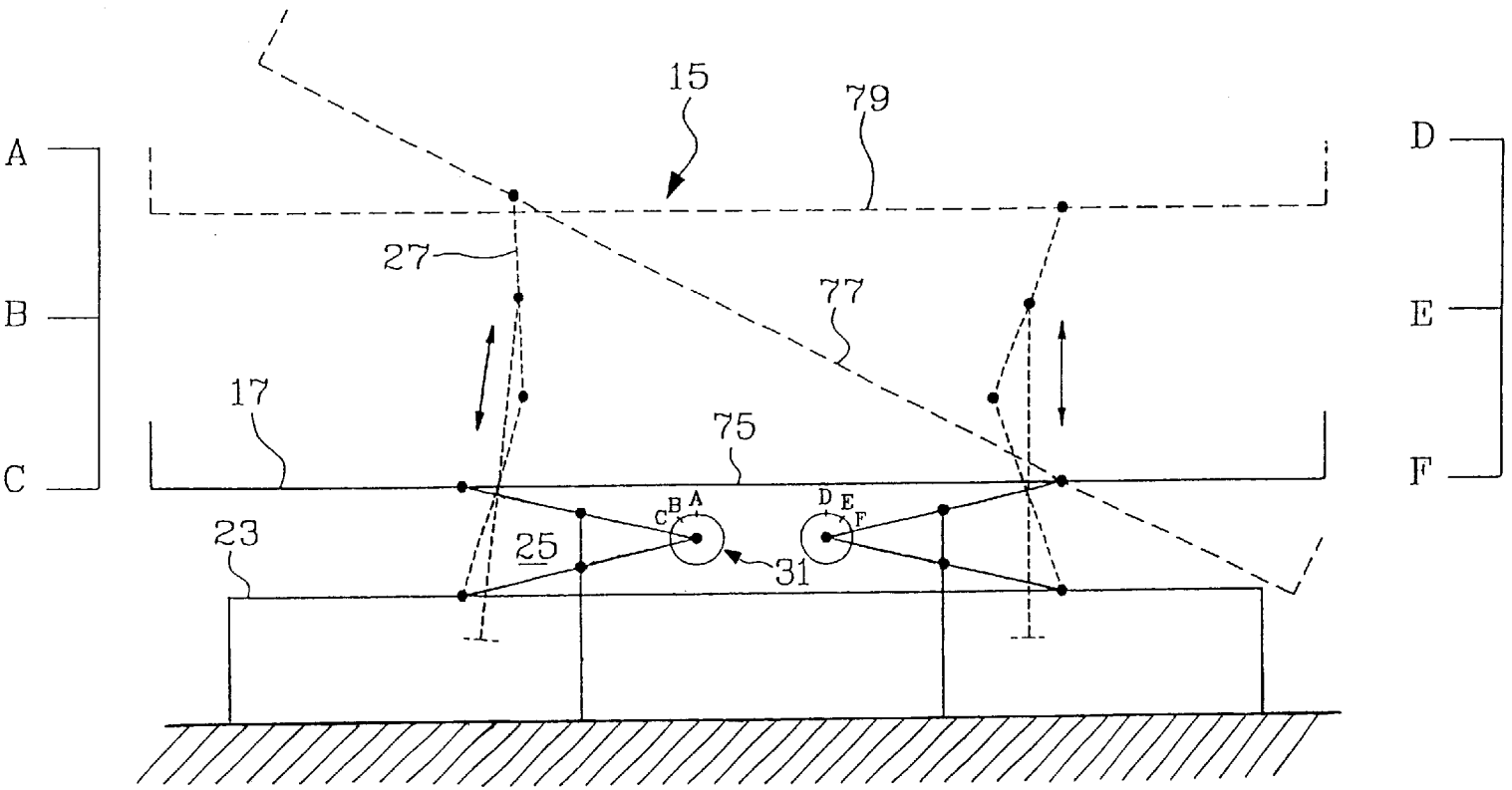
FIG. 6A shows manners of changing and controlling the position of the upper bed frame relative to the lower bed frame and the angles of inclination of two ends of the mattress for the power-controlled bed of FIG. 1.
Figure 6B:
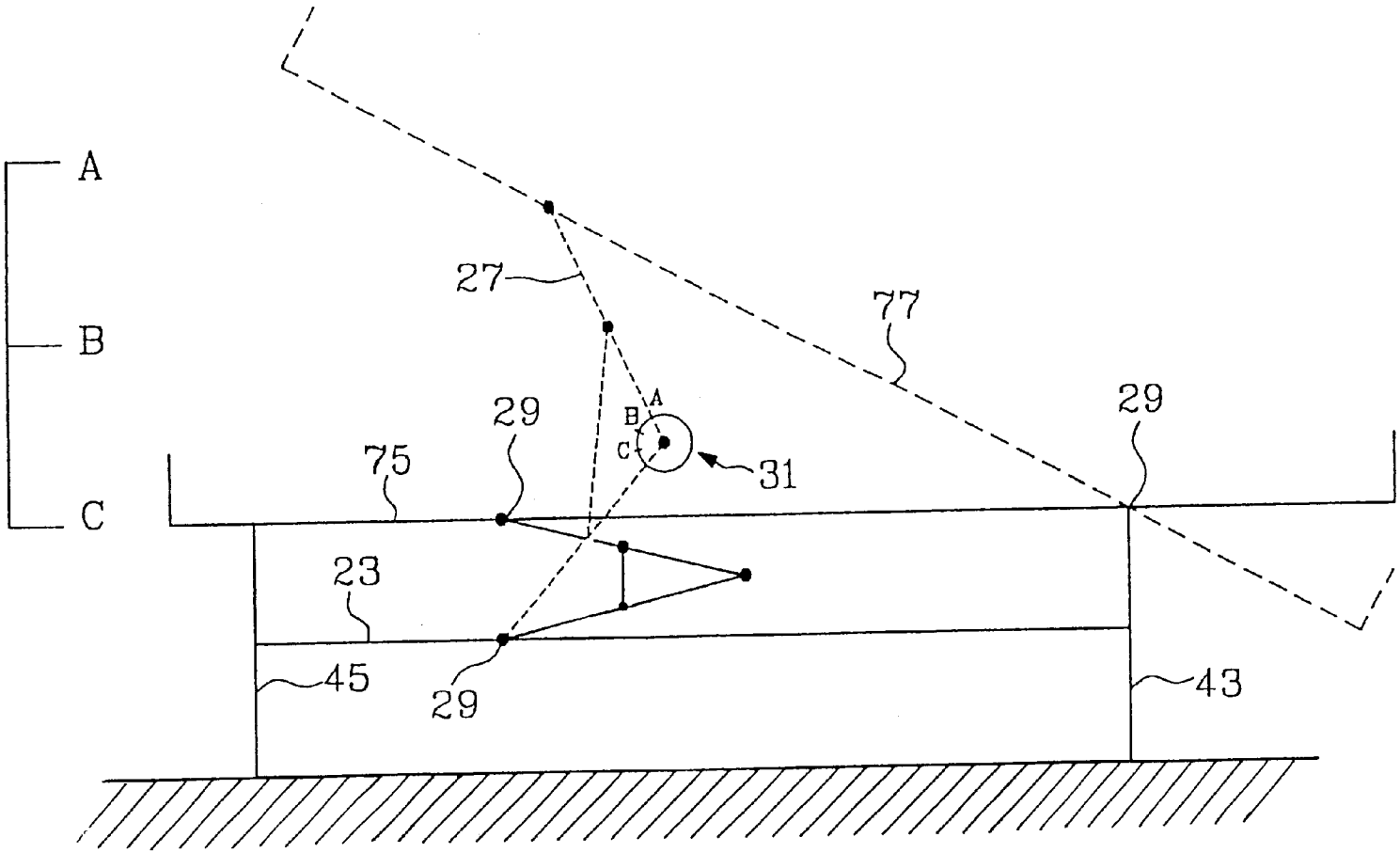
FIG. 6B shows manners of changing and controlling position and angle of inclination of the upper bed frame relative to the lower bed frame for the power-controlled bed of FIG. 3.

FIGS. 6A and 6B show manners of changing and controlling the position of the upper bed frame relative to the lower bed frame and the angles of inclination of two ends of the mattress for the power-controlled beds of FIGS. 1 and 3, respectively. In FIGS. 6A and 6B, a solid line 75 represents the upper bed frame 17 in a horizontal position, and two phantom lines 77 and 79 represent the upper bed frame 17 in a rearward inclined position and a horizontally elevated position, respectively. Each of the front and the rear lifting mechanisms 25 may include, for example, a three-position limit switch 31. The three positions of the limit switch 31 correspond to high, middle, and low positions in a travel of the lifting mechanism 25. Address parameters for the upper bed frame 17 may be directly obtained from readings of the three-position limit switches 31. The obtained address parameters are compiled, combined, and converted into control procedures, and input the microcomputer controller. A user may enter an instruction via the microcomputer controller, which then compares and operates to decide a timed, randomized or sequenced operation for the motor driver to execute the following different dynamic and static control modes for the bed of the present invention.

The bed control modes obtained from the above-mentioned manner may generally include the following types:

A. Manual & Static Control Mode:

A hand controller is provided to control the front and the rear lifting mechanisms 25. Select desired travels for the two limit switches 31 and push correct keys on the hand controller. When the correct keys are pushed and held, the upper bed frame 17 is kept moving; and when the keys are released, the upper bed frame 17 stops moving. When the upper bed frame 17 moves to high and low limit points set for the limit switches 31, it automatically moves in a reverse direction. A user may freely adjust the upper bed frame 17 to any desired position in each control and then the bed is maintained in a static state.

B. Automatic & Static Control Mode:

This control mode may be executed in two stages, namely, selecting a desired bed position and performing the control.

(1) Selecting a Desired Bed Position:

The high, middle, and lower positions on the limit switch for the travel of the front lifting mechanism 25 is denoted with letters A, B, and C; and the high, middle, and low positions on the limit switch for the travel of the rear lifting mechanism 25 is denoted with letters D, E, and F. There are at least 15 static bed position combinations available for users, including A+D (high front and high rear), A+E (high front and middle rear), A+F (high front and low rear), B+D (middle front and high rear), B+E (middle front and middle rear), B+F (middle front and low rear), C+D (low front and high rear), C+E (low front and middle rear), C+F (low front and low rear), D+B (high rear and middle front), D+C (high rear and low front), E+A (middle rear and high front), E+C (middle rear and low front), F+A (low rear and high front), and F+B (low rear and middle front).

(2) Performing the Control:

The above 15 static bed position combinations are numbered from 01 to 15 to provide a bed position list. A user may select a desired static bed position combination number from the bed position list and push a corresponding numeral key on the hand controller. On receiving the input number, the controller will identify an instruction corresponding to the input number and determine rotating directions for the motors of the front and the rear lifting mechanisms 25. For example, an instruction in the form of A–B means the user desires a high position for the front end of the bed while the latter is initially in a middle position. At this point, the motor of the front lifting mechanism 25 is caused to rotate clockwise and thereby ascend the front end of the bed to the high position. And, an instruction in the form of C–B means the user desires a low position for the front end of the bed while the latter is initially in a middle position. At this point, the motor of the front lifting mechanism 25 is caused to rotate counterclockwise and thereby descend the front end of the bed to the low position. And, an instruction in the form of A–A means the motor of the front lifting mechanism 25 does not rotate and the front end of the bed is stopped at the high position without moving.

Instructions for the motors of the two lifting mechanisms 25 to rotate clockwise include A–B, A–C, B–C, D–E, D–F, and E–F; and instructions for the motors of the two lifting mechanisms 25 to rotate counterclockwise include C–A, C–B, B–A, F–D, F–E, and E–D; and instructions for the motors of the two lifting mechanisms 25 to stay unmoved include A–A, B–B, C–C, D–D, E–E, and F–F.

After a bed position combination number for the upper bed frame 17 is selected, the bed is maintained in that selected position in a static state.

C. Automatic & Dynamic Control Mode:

This control mode maybe executed in two stages, namely, selecting a desired bed position and performing the control.

(1) Selecting a Desired Bed Position:

Again, the high, middle, and low positions on the limit switch for the travel of the front lifting mechanism 25 is denoted with alphabets A, B, and C; and the high, middle, and low positions on the limit switch for the travel of the rear lifting mechanism 25 is denoted with alphabets D, E, and F. There are at least 22 dynamic bed position combinations available for users, including A+D⇔E (the front of the bed is fixed in the high position while the rear of the bed is reciprocatingly shifted between the high and the middle positions), A+D⇔F (the front of the bed is fixed in the high position while the rear of the bed is reciprocatingly shifted between the high and the low positions), A+E⇔F, B+D⇔E, B+D⇔F, B+E⇔F, C+D⇔E, C+D⇔F, C+E⇔F, D+A⇔B, D+A⇔C, D+B⇔C, E+A⇔B, E+A⇔C, E+B⇔C, F+A⇔B, F+A⇔C, F+B⇔C, A+F⇔C+D (the front and the rear ends of the bed are alternately ascended and descended) A+D⇔C+F (the front and the rear ends of the bed are horizontally ascended and descended at the same time between the high and the low positions), B+E⇔C+F, and A+D⇔B+E (the front and the rear ends of the bed are horizontally ascended and descended at the same time between the high and the middle positions).

(2) Performing the Control:

The above 22 dynamic bed position combinations are numbered from 16 to 37 to provide a bed position list. A user may select a desired dynamic bed position combination number from the bed position list and push a corresponding numeral key on the hand controller. On receiving the input number, the controller will follow an instruction corresponding to the desired control for the motors of the front and the rear lifting mechanisms 25 to continuously, regularly, and reciprocatingly operate until a preset time has lapsed or a time setting is cleared. Then, the upper bed frame 17 will return to the static C+F position, that is, both the front and the rear ends of the bed will stay at the low position.

D. Automatic & Random Control Mode:

In this control mode, address parameters obtained from the limit switches 31 while the lifting mechanisms 25 are traveling among the high, middle, and low positions, as well as motor rotating parameters (such as quick, moderate, slow) and motor inverting pause time parameters (such as 5, 10, and 15 seconds) are input to the microcomputer for further combining and processing to provide more extended modes. A user may push a RANDOM key on the hand controller for the two lifting mechanisms 25 to operate irregularly, so that two ends of the upper bed frame 17 are caused to locate at different positions in irregular manners and at irregular speeds until a preset operating time is cleared. The upper bed frame 17 is then returned to the horizontal low position 75. A user is distracted due to unpredictable changes in the bed position and is therefore temporarily relieved from the mental pressure.

FIG. 6B shows manners of changing and controlling positions and angles of inclination of the upper bed frame 17 relative to the lower bed frame 23 for the power-controlled bed 1 of FIG. 3. Except that only one lifting mechanism 25 is included in the operation and that the front end of the upper bed frame 17 is pivotally fixed to the low position, the bed 1 of FIG. 3 is controllable in all the above-mentioned four modes.

Figure 7:
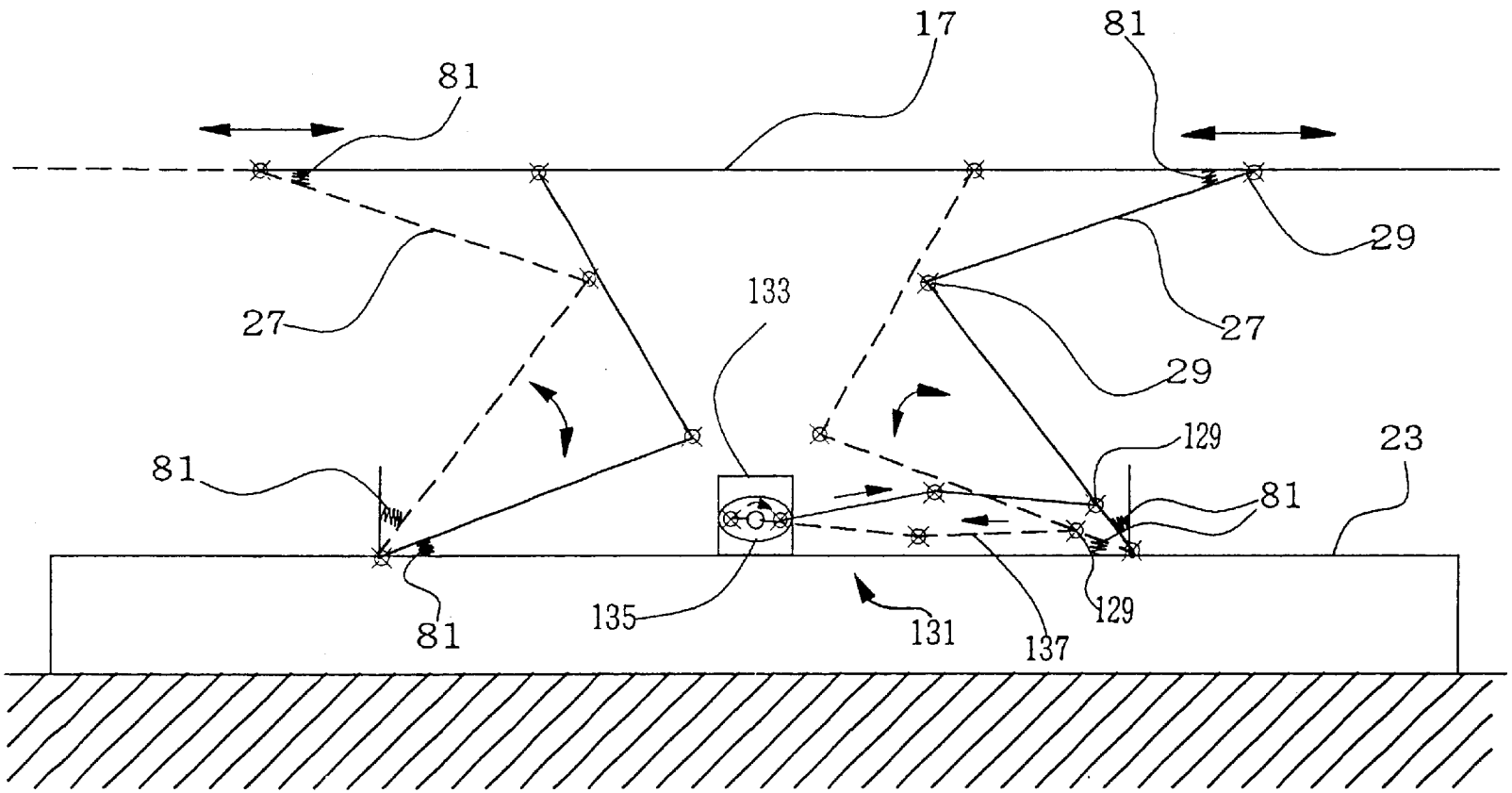
FIG. 7 is a schematic side view showing a crank pivoting means for the bed of the present invention and the manner in which the bed is swung with the crank pivoting means.

E. Automatic & Horizontally Swung Control Mode:

Please refer to FIG. 7 that is a schematic side view showing crank pivoting means 131 for the bed of the present invention and the manner in which the bed is swung with the crank pivoting means 131. Spring-loaded locators 81 are provided at predetermined positions near joints of the upper cranks 27 and the upper bed frame 17, and joints of the lower cranks 27 and the lower bed frame 23 to serve as buffers when the cranks 27 are caused to move about the pivot joints 29, and to limit the cranks 27 to an acceptable range of movement.

A bottom crossbar 129 is provided below each lower crossbar 33 to extend between a pair of the lower cranks 27 located at each end below the upper bed frame 17. The bottom crossbar 129 is provided at a middle point with the crank pivoting means 131. The crank pivoting means 131 includes a motor 133 that rotates an eccentric wheel 135 to thereby push and pull a pivoting crank 137 connected to the bottom crossbar 129, so that the bottom crossbar 129 is forced to reciprocatingly move forward and backward within a range of movement of the lower cranks 27 and thereby brings the upper bed frame 17 of the bed 1 to reciprocatingly translate and thereby swing forward and backward.

With the above arrangements and control modes, the power-controlled bed 1 of the present invention provides not only the general functions of adjusting the angles of inclination of the back rest part and the connected leg and thigh rest parts of the mattress, but also a plurality of changeful bed position combinations for the upper bed frame 17 to automatically and continuously shift in different manners that are not found in the multi-functional bed structures of the prior art and of the earlier and allowed invention made by the same applicant of the present invention. The power-controlled bed of the present invention also includes simplified structure and lowered manufacturing cost and selling price to meet general consumers' requirements and is therefore practical and economical for use.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A power-controlled bed comprising:

a mattress divided into a movable back rest part, a fixed hip rest part, and movable thigh and leg rest parts that are connected to each other;

an upper bed frame supporting said mattress;

at least one set of lifting mechanisms for moving said upper bed frame into different horizontal and inclined positions;

at least one set of crank pivoting device for reciprocatingly translating said upper bed frame forward and backward;

a lower bed frame supporting said at least one set of lifting mechanisms and said at least one set of crank pivoting device; and a microcomputer controller for controlling operations of said bed;

said at least one set of lifting mechanisms including:

two pairs of upper and lower cranks, each single pair of said upper and lower cranks being connected at inner ends to each other via a first pivot joint, and at outer ends to predetermined points on said upper and said lower bed frames, respectively, via second pivot joints;

an upper and a lower crossbar extended between and are connected to each of said two pairs of upper and lower cranks; and a threaded-rod elevator connected to and between said upper and said lower crossbars for moving said upper and said lower crossbars up or down and thereby pushing or pulling said upper cranks away from or toward said lower cranks, respectively, causing said upper bed frame pivotally connected to said upper cranks to ascend or descend; and said at least one set of crank pivoting device being connected to a bottom crossbar provided below one of said lower crossbars to extend between a pair of said lower cranks located at one end below said upper bed frame, and including a motor that rotates an eccentric wheel to thereby push and pull a pivoting crank connected to said bottom crossbar, so that said bottom crossbar is forced to reciprocatingly move forward and backward within a range of movement of said lower cranks and thereby causes said upper bed frame to reciprocatingly translate and swing forward and backward.

2. The power-controlled bed as claimed in claim 1, wherein said bed includes only one set of said lifting mechanisms that is mounted on said lower bed frame close to a middle portion thereof for elevating a rear end of said upper bed frame to different heights and therefore holding said upper bed frame to different angles of inclination.

3. The power-controlled bed as claimed in claim 1, wherein said bed includes two sets of said lifting mechanisms that are separately mounted on said lower bed frame close to a front and a rear end thereof for elevating front and rear ends of said lower bed frame to different heights and therefore holding said upper bed frame to different angles of inclination.

4. The power-controlled bed as claimed in claim 1, wherein said threaded-rod elevator of said at least one set of bed lifting mechanisms is a horizontal threaded-rod elevator; said horizontal threaded-rod elevator including a rhombic linkage having four movable links, outer ends of which being separately connected to said upper and said lower crossbars, and inner ends of which being connected to two horizontally spaced and internally threaded rings, and a motor connected to a suspension bottom plate for driving a speed change gearbox to rotate a threaded rod, which is rotatably mounted between two bearings located at two outer ends of said suspension bottom plate to extend through said two internally threaded rings and is provided on two opposite sections at two sides of the gearbox with reverse threads; whereby when said motor is actuated, said internally threaded rings spaced on said two opposite sections of said threaded rod are brought to displace relative to each other and thereby force said four links of said rhombic linkage to different angular positions relative to said upper and said lower crossbar to thereby push or pull said upper and said lower crossbar to move said upper cranks away from or close to said lower cranks.

5. The power-controlled bed as claimed in claim 1, wherein said threaded-rod elevator of said lifting mechanism is a vertical threaded-rod elevator; said vertical threaded-rod elevator including a motor that drives a speed change gearbox to rotate an internally threaded ring, so that a threaded rod meshed with said threaded ring is caused to move up and down and thereby pushes or pulls said crossbars to move said upper cranks away from or close to said lower cranks.

* * * * *